US005815065A

United States Patent [19]

Hanamura

[11] Patent Number: 5,815,065

[45] Date of Patent: Sep. 29, 1998

[54] CHIP RESISTOR DEVICE AND METHOD OF MAKING THE SAME

[75] Inventor: Toshihiro Hanamura, Kyoto, Japan

[73] Assignee: Rohm Co. Ltd., Kyoto-fu, Japan

[21] Appl. No.: 779,108

[22] Filed: Jan. 6, 1997

[30] Foreign Application Priority Data

Jan. 10, 1996 [JP] Japan ..... 8-002152

[51] Int. Cl.[6] ..... H01C 1/012

[52] U.S. Cl. ..... 338/309; 338/309; 338/332; 338/308

[58] Field of Search ..... 338/332, 309, 338/319, 308, 22 R, 293, 325

[56] References Cited

U.S. PATENT DOCUMENTS

| | | | |
|---|---|---|---|
| 5,258,728 | 11/1993 | Schat et al. | 338/332 |
| 5,287,083 | 2/1994 | Person et al. | 338/332 |
| 5,339,068 | 8/1994 | Tsunoda et al. | 338/332 |
| 5,379,017 | 1/1995 | Katsuno et al. | 338/332 |
| 5,450,055 | 9/1995 | Doi et al. | 338/332 |
| 5,548,269 | 8/1996 | Katsuno et al. | 338/332 |
| 5,680,092 | 10/1997 | Yamada et al. | 338/309 |

*Primary Examiner*—Renee S. Luebke
*Assistant Examiner*—Jeffrey Pwu
*Attorney, Agent, or Firm*—Michael D. Bednarek; Kilpatrick Stockton LLP

[57] ABSTRACT

A chip resistor device includes an insulating chip substrate having a top surface formed with a resistor film which is covered by a protective coating. The top surface of the substrate is also formed with a pair of terminal electrodes provided at both ends of the chip substrate. Each of the terminal electrodes includes a main top electrode layer formed on the top surface of the chip substrate in electrical conduction with the resistor film, an auxiliary top electrode layer formed on the main top electrode layer, a side electrode layer formed on a corresponding end face of the chip substrate, and a plated metal electrode layer formed on the auxiliary top electrode layer and the side electrode layer. The auxiliary top electrode layer is formed with a cutout at which the plated metal electrode layer is held in direct contact with the main top electrode layer.

7 Claims, 10 Drawing Sheets

CHIP RESISTOR DEVICE AND METHOD OF MAKING THE SAME

BACKGROUND OF THE INVENTION

1. Field of the Invention

The present invention relates to a chip resistor chip of the type which comprises an insulating chip substrate formed with a resistor film. The present invention also relates a method of making such a chip resistor device.

2. Description of the Related Art

Typically, a conventional chip resistor device includes an insulating chip substrate having a top surface formed with a resistor film covered by a protective glass coating. Each end of the chip substrate is provided with a terminal electrode in electrical conduction with the resistor film. Such a chip resistor device is disclosed in Japanese Patent Application Laid-open No. 60(1985)-27104 for example.

In the conventional chip resistor device, the protective glass coating projects upwardly to a much greater extent than the upper surface of the terminal electrode. Thus, due to a poor surface flatness, when an attempt is made to pick up the chip resistor device by a suction collet for handling, such an attempt may fail, or alternatively the resistor device once picked may fall from the suction collet. Further, when the chip resistor device need be mounted upside down on a circuit board, the electrode terminal of the resistor device may be excessively spaced from the circuit board particularly if the chip device tips toward one end.

Japanese Patent Application Laid-open No. 4(1992)-102302 discloses a chip resistor device which eliminates or reduces the above-described problems. For the convenience of description, such a resistor device is now explained with reference to FIGS. 15 and 16 of the accompanying drawings.

As shown in FIGS. 15 and 16, the prior art chip resistor device comprises an insulating chip substrate 1 whose top surface is formed with a resistor film 2 in electrical conduction with terminal electrodes 3 at both end of the substrate 1. Further, the resistor film 2 is covered by a protective coating 4.

Each of the terminal electrodes 3 includes a main top electrode layer 3*a* formed on the top surface of the substrate 1 in direct contact with the resistor film 2, an auxiliary top electrode layer 3*b* formed on the main top electrode 3*a*, a side electrode layer 3*c* formed on a corresponding end face of the substrate 1, and a plated metal electrode layer 3*d* formed on the auxiliary top electrode layer 3*b* and the side electrode layer 3*c*.

The auxiliary top electrode layer 3*b* is formed relatively thick to provide an improved surface flatness in combination with the protective coating 4.

The protective coating 4 includes a primary coating layer 4*a* of glass formed directly on the resistor film 2, and a secondary coating layer 4*b* of glass or synthetic resin formed on the primary coating layer 4*a*.

The chip resistor device having the above-described structure may be produced in the following manner.

First, as shown in FIG. 17, each of the main top electrode layers 3*a* is formed on the top surface of the insulating chip substrate 1 at a respective end thereof by printing a silver-palladium paste which is thereafter dried and baked for fixation.

Then, as shown in FIG. 18, the resistor film 2 is formed on the top surface of the chip substrate 1 in conduction with the respective main top electrode layers 3*a* by printing a resistor material paste which is thereafter dried and baked for fixation.

Then, as also shown in FIG. 18, the primary coating layer 4*a* is formed on the resistor film 2 by printing a glass paste which is thereafter dried and baked for fixation.

Then, as also shown in FIG. 19, while probes (not shown) are held in contact with the two main top electrode layers 3*a* for resistance measurement, a trimming groove 15 is formed in the resistor film 2 and the primary coating layer 4*a* by irradiating a laser beam until the measured resistance of the resistor film 2 falls in a predetermined tolerable range.

Then, as shown in FIG. 16, the secondary coating layer 4*b* is formed over the primary coating layer 4*a* by printing a glass paste which is later dried and baked for fixation.

Then, as shown in FIG. 20, each of the auxiliary top electrode layers 3*b* is formed on a respective one of the main top electrodes 3*a* by printing a silver-palladium paste which is later dried and baked for fixation.

Then, as also shown in FIG. 20, each of the side electrode layers 3*c* is formed on a respective end face of the chip substrate 1 by applying a silver-palladium paste which is later dried and baked for fixation.

Finally, each of the plated metal electrode layers 3*d* (see FIGS. 15 and 16) is formed on the auxiliary top electrode layer 3*b* and the side electrode layer 3*c* by plating.

The prior art chip resistor device is mounted on a circuit board and electrically connected to relevant electrode pads by soldering the plated metal electrode layers 3*d*. Thus, when the thickness of each electrode terminal 3 is increased by interposing the auxiliary top electrode layer 3*b* between the main top electrode layer 3*a* and the plated metal electrode layer 3*d*, the inherent resistance of the auxiliary top electrode layer 3*b* is additional to the resistance of the resistor film 2. In this regard, it should be appreciated that the auxiliary top electrode layer 3*b* which is made of a silver-palladium paste has a non-negligible resistivity, whereas the metal electrode layer 3*d* formed by plating has a negligible resistivity.

On the other hand, the trimming of the resistor film 2 for resistance adjustment is performed before the auxiliary top electrode layer 3*a* is formed, as shown in FIG. 18. Thus, even if the resistor film 2 is appropriately trimmed to have a resistance falling in a predetermined tolerable range, the resistance of the chip resistor device as a whole may fall out of the tolerable range due to the subsequent formation of the auxiliary top electrode layer 3*b*. Such a problem may be particularly critical when the resistor film 2 need be trimmed to have a small resistance.

SUMMARY OF THE INVENTION

It is, therefore, an object of the present invention to provide a chip resistor device which is made to have an accurately adjusted resistance during and after its manufacturing process.

Another object of the present invention is to provide a method of advantageously making such a chip resistor device.

According to one aspect of the present invention, there is provided a chip resistor device comprising: an insulating chip substrate having a top surface and an opposite pair of end faces; a resistor film formed on the top surface of the chip substrate; a protective coating formed on the top surface of the chip substrate for covering the resistor film; and a pair of terminal electrodes provided at both ends of the chip substrate, each of the terminal electrodes including a main top electrode layer formed on the top surface of the chip substrate in electrical conduction with the resistor film, an auxiliary top electrode layer formed on the main top electrode layer, a side electrode layer formed on a corresponding end face of the chip substrate, and a plated metal electrode layer formed on the auxiliary top electrode layer and the side electrode layer; wherein the auxiliary top electrode layer is formed with a cutout at which the plated metal electrode layer is held in direct contact with the main top electrode layer.

The technical advantages obtained due to the above structure of the chip resistor device will be described later on the basis of the preferred embodiments.

In one preferred embodiment, the cutout completely divides each auxiliary top electrode layer into two separate portions.

In another preferred embodiment, each auxiliary top electrode layer is an integral one-piece, and the cutout is open upwardly and toward the corresponding end face of the chip substrate.

In a further preferred embodiment, each auxiliary top electrode layer is an integral one-piece, and the cutout is open upwardly and toward the resistor film.

In still another preferred embodiment, each auxiliary top electrode layer is slightly spaced to longitudinal edges of the chip substrate.

In either of these embodiments, the resistor film may be provided with a trimmed portion for resistance adjustment. Further, the protective coating may include a primary coating layer formed directly on the resistor film, and a second coating layer formed on the primary coating layer.

According to another aspect of the present invention, there is provided a method of making a chip resistor device comprising the steps of: forming a resistor film on a top surface of an insulating chip substrate which also has an opposite pair of end faces; forming a protective coating on the top surface of the chip substrate for covering the resistor film; forming a main top electrode layer on the top surface of the chip substrate adjacent to each end face thereof in electrical conduction with the resistor film; trimming the resistor film for resistance adjustment; forming an auxiliary top electrode layer on the main top electrode layer in a manner such that a portion of the main top electrode layer is exposed; forming a side electrode layer on said each end face of the chip substrate; and forming a plated metal electrode layer on the auxiliary top electrode layer, the side electrode layer and the exposed portion of the main top electrode layer.

Other objects, features and advantages of the present invention will become apparent from the following description of the preferred embodiment given with reference to the accompanying drawings.

BRIEF DESCRIPTION OF THE DRAWINGS

In the accompanying drawings:

FIG. 13 is a perspective view showing a principal portion of a chip resistor device according to a fourth embodiment of the present invention;

DETAILED DESCRIPTION OF THE PREFERRED EMBODIMENTS

Figure 15:
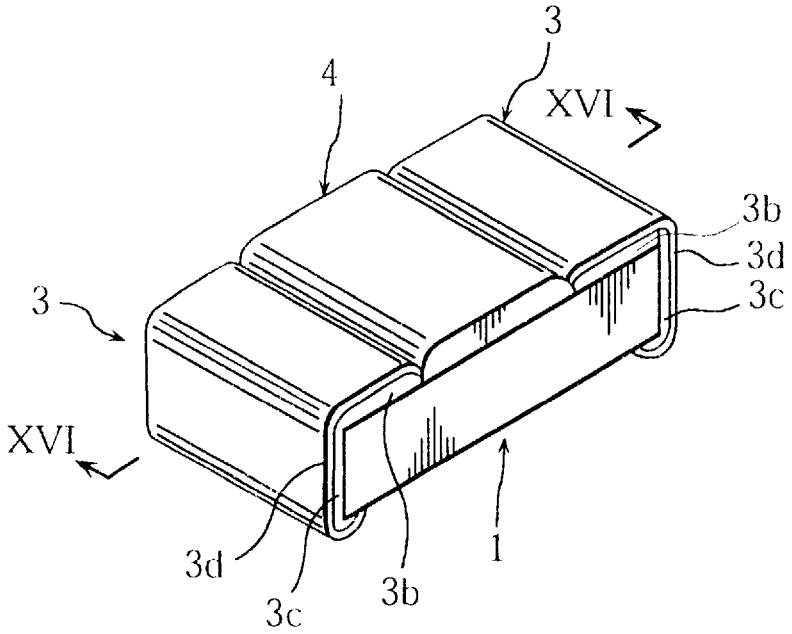
Fig. 15 Prior Art
FIG. 15 is a perspective view showing a prior art chip resistor device.
Figure 16:
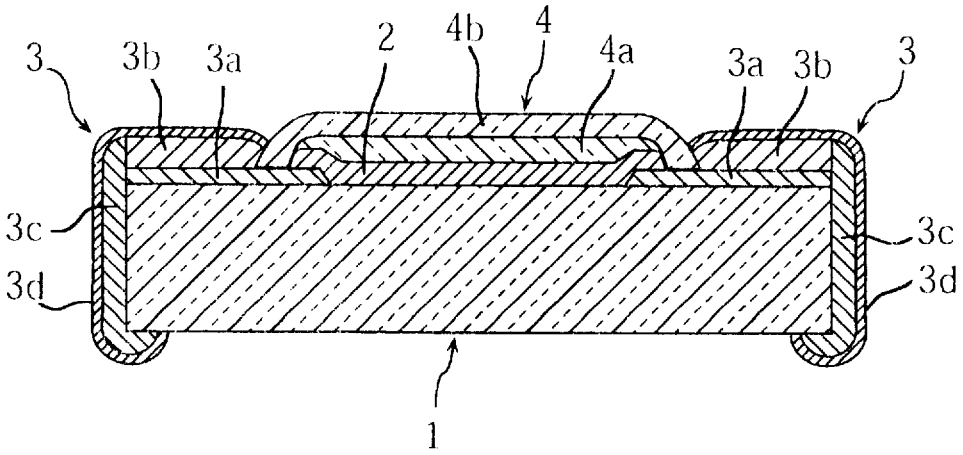
Fig. 16 Prior Art
FIG. 16 is an enlarged sectional view taken alongs lines XVI—XVI in FIG. 15.
Figure 17:
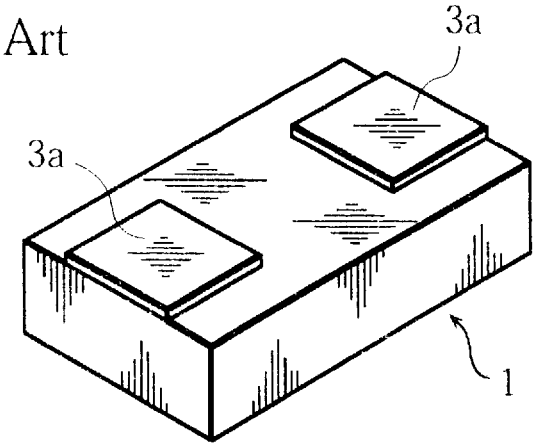
Fig. 17 Prior Art
FIGS. 17 through 20 are perspective views showing the successive steps of making the prior art resistor device.
Figure 18:
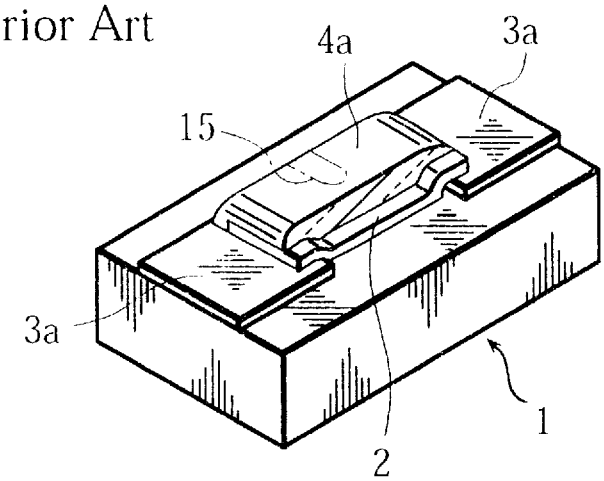
Fig. 18 Prior Art
Figure 19:
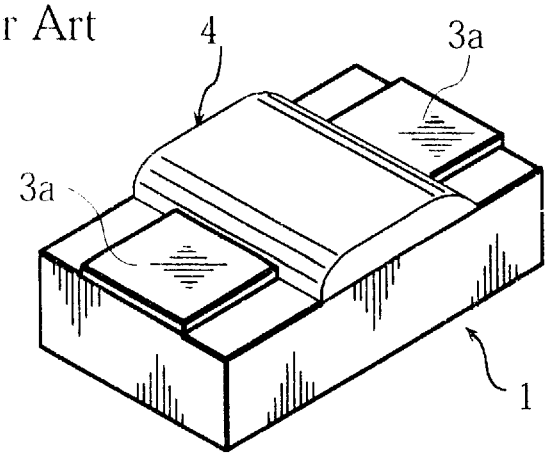
Fig. 19 Prior Art
Figure 20:
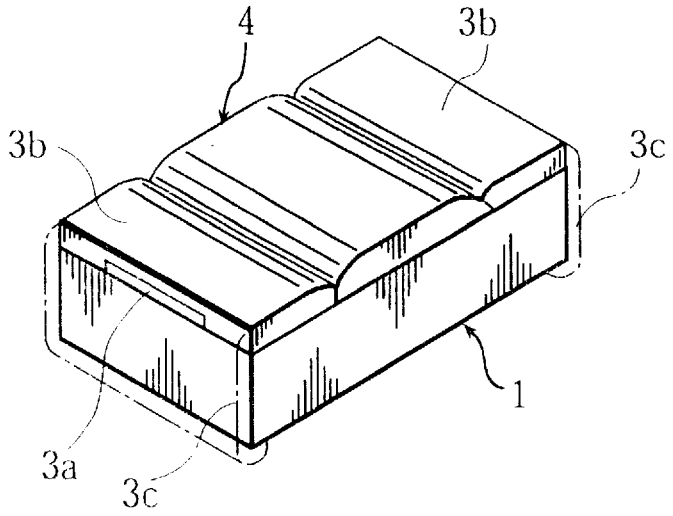
Fig. 20 Prior Art

FIGS. 1 through 5 of the accompanying drawings show a chip resistor device according to a first embodiment of the present invention. Like the prior art illustrated in FIGS. 15 and 16, the chip resistor device of this embodiment comprises a chip substrate 11 made of an insulating material. The substrate 11 has a top surface formed with a resistor film 12 in electrical conduction with terminal electrodes 13 at both end of the substrate 11.

Each of the terminal electrodes 13 includes a main top electrode layer 13*a* formed on the top surface of the substrate 11 in direct contact with the resistor film 12, an auxiliary top electrode layer 13*b* formed on the main top electrode 13*a*, a side electrode layer 13*c* formed on a corresponding end face of the substrate 11, and a plated metal electrode layer 13*d* formed on the auxiliary top electrode layer 13*b* and the side electrode layer 13*c*. The main top electrode 13*a* may be typically made of a silver-palladium paste. The auxiliary top electrode layer 13*b*, which may be also made of a silver palladium paste, is relatively thick to raise the plated metal electrode layer 13*d* from the top surface of the substrate 11.

The resistor film 12 is entirely coverd by a protective coating 14. This protective coating includes a primary coating layer 14*a* of glass formed directly on the resistor film 12, and a secondary coating layer 14*b* of glass or resin formed on the primary coating layer 14*a*.

Figure 1:
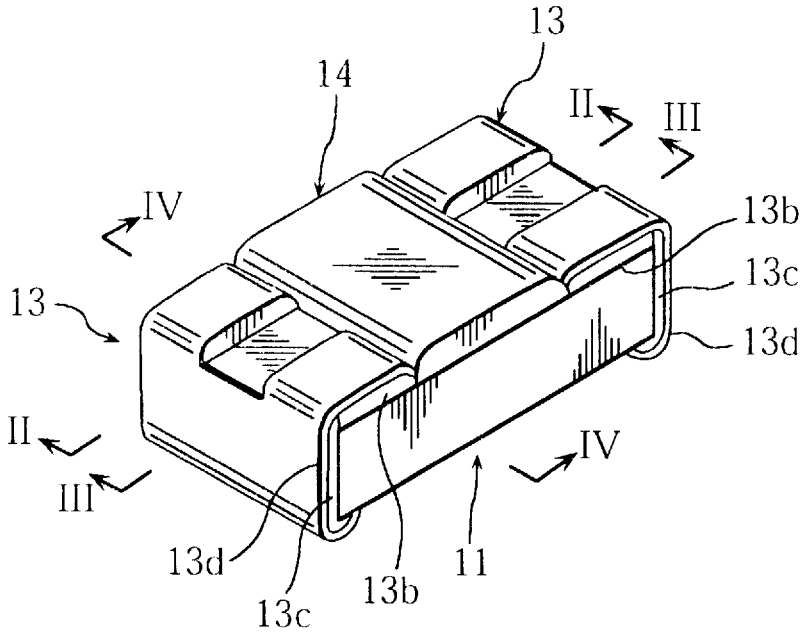
FIG. 1 is a perspective view showing a chip resistor device according to a first embodiment of the present invention.
Figure 2:
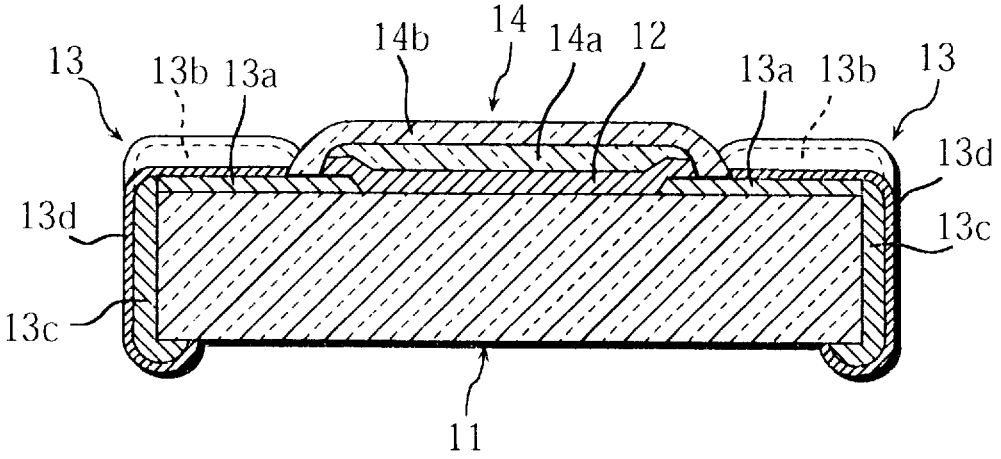
FIG. 2 is an enlarged sectional view taken along lines II—II in FIG. 1.
Figure 3:
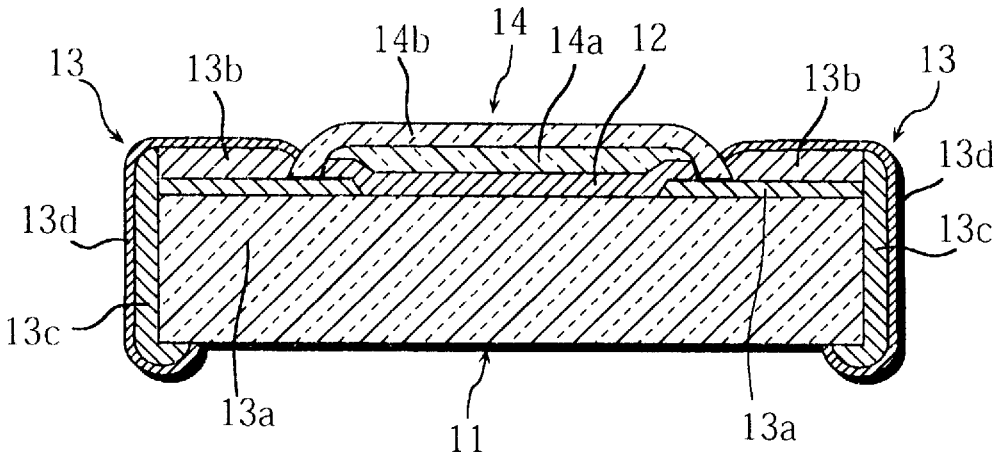
Figure 4:
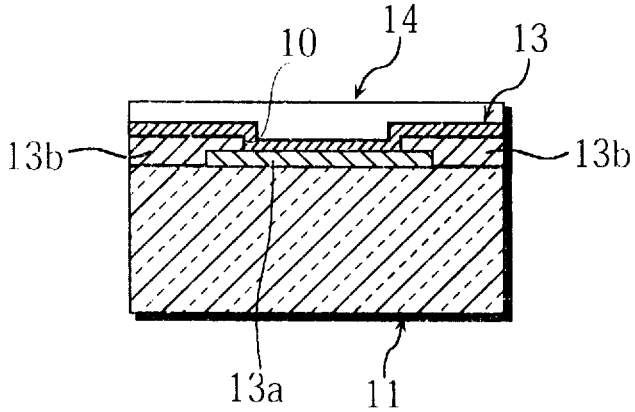
FIG. 4 is an enlarged sectional view taken along lines IV—IV in FIG. 1.
Figure 5:
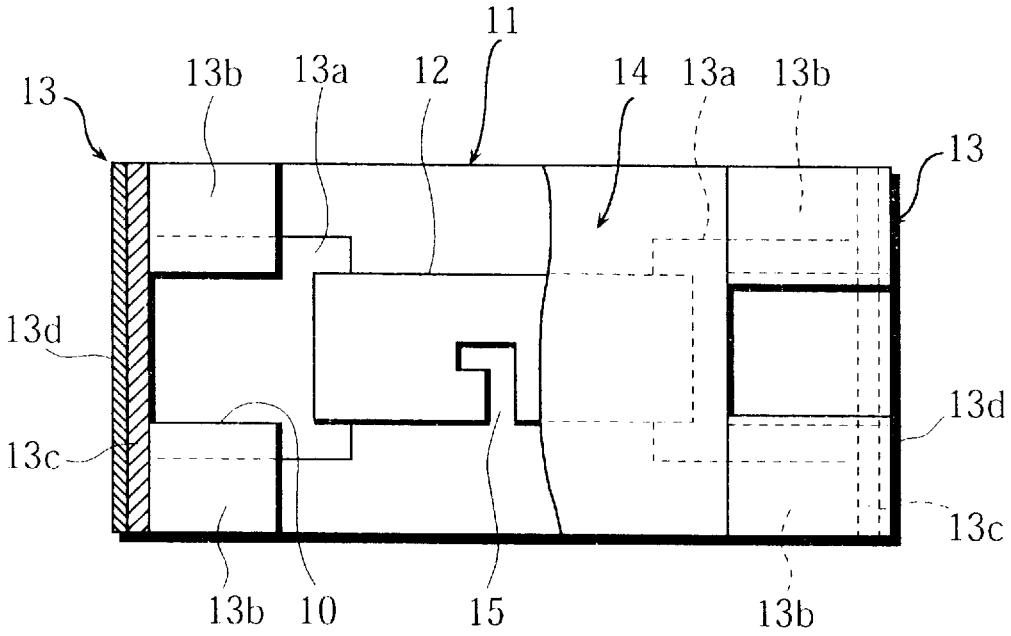
FIG. 5 is a plan view, partially cut away and partially sectioned, showing the same resistor device.

As best shown in FIGS. 4 and 5, the auxiliary top electrode layer 13*b* of each terminal electrode 13 has a cutout 10 at the position of the main top electrode layer 13*a*. In the illustrated embodiment, the cutout 10 divides the auxiliary top electrode layer 13*b* into two portions spaced widthwise of the substrate 11. Thus, the main top electrode layer 13*a* is partially exposed at the cutout 10, and the exposed portion of the main top electrode layer 13*a* comes into direct contact with the plated metal electrode layer 13*d*.

The auxiliary top electrode layer 13*b*, which is made of a silover-palladium paste, has a higher inherent resistivity than the resistivity of the plated metal electrode layer 13*d* (which is negligible). However, since the plated metal electrode layer 13*d* is held in direct contact with the main top electrode layer 13*a* at the cutout 10 of the auxiliary top electrode layer 13*b*, the inherent resistivity of the auxiliary top electrode layer 13*b* is not additional to the resistance of the chip resistance device as a whole. On the other hand, the auxiliary top electrode layer 13*b* provides a raised surface at each side of the cutout 10 to improve surface flatness of the chip resistor device as a whole in comparison with the arrangement where no such auxiliary top electrode layer 13*b* is provided, thereby facilitating handling of the chip resistor device with a suction collet (not shown) and/or upside-down mounting of the chip resistor device.

The chip resistor device having the above-described structure may be produced in the following manner.

Figure 6:
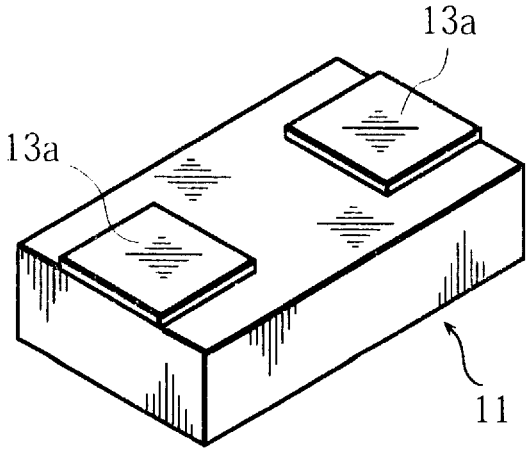
FIG. 6 through 10 are perspective views showing the successive steps of making the same resistor device.

First, as shown in FIG. 6, each of the main top electrode layers 13*a* is formed on the top surface of the insulating chip substrate 11 at a respective end thereof by printing a silver-palladium paste which is thereafter dried and baked for fixation.

Figure 7:
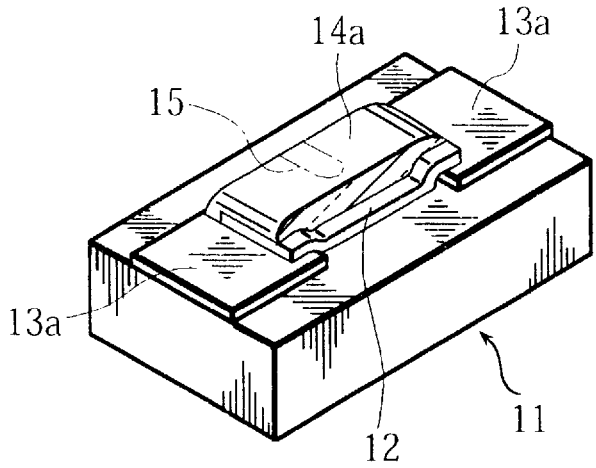

Then, as shown in FIG. 7, the resistor film 12 is formed on the top surface of the chip substrate 11 in conduction with the respective main top electrode layers 13*a* by printing a resistor material paste which is thereafter dried and baked for fixation.

Then, as also shown in FIG. 7, the primary coating layer 14*a* is formed on the resistor film 12 by printing a glass paste which is thereafter dried and baked for fixation.

Then, as also shown in FIG. 7, while probes (not shown) are held in contact with the two main top electrode layers 13*a* for resistance measurement, a trimming groove 15 is formed in the resistor film 12 and the primary coating layer 14*a* by irradiating a laser beam until the measured resistance of the resistor film 12 falls in a predetermined tolerable range.

Figure 8:
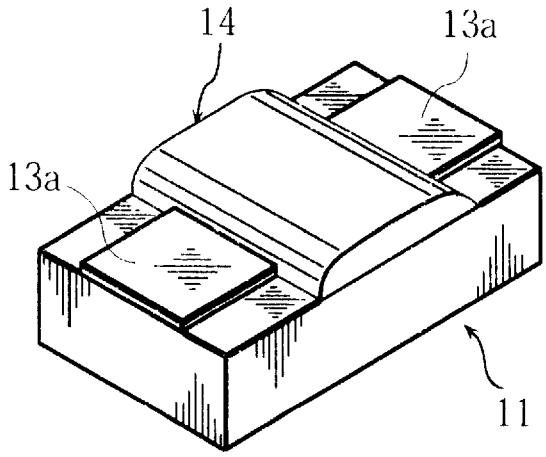

Then, as shown in FIG. 8, the secondary coating layer 14*b* is formed over the primary coating layer 14*a* by printing a glass paste which is later dried and baked for fixation. Alternatively, the secondary coating layer 14*b* may be formed by applying a fluid resin and thereafter allowing the applied resin to cure.

Figure 9:
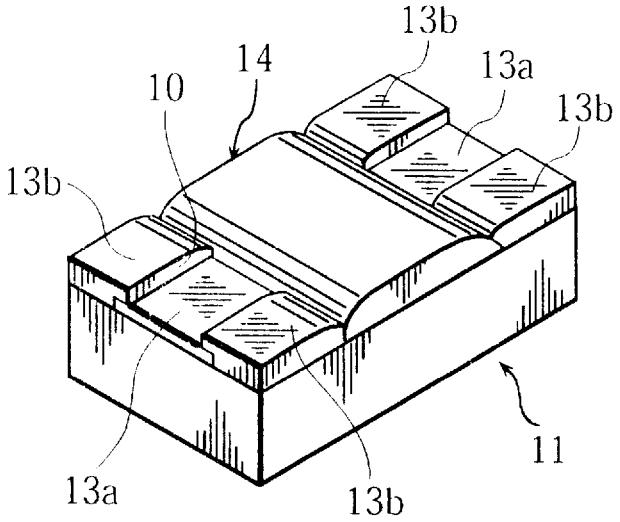

Then, as shown in FIG. 9, each of the auxiliary top electrode layers 13*b* is formed on a respective one of the main top electrodes 13*a* by printing a silver-palladium paste which is later dried and baked for fixation. At this time, the printing of the silver-palladium paste is performed in a manner such that each main top electrode layer 13*a* is exposed at the cutout 13*a*. It should be appreciated that the term "cutout" is used herein to mean that a portion of the auxiliary top electrode 13*b* is omitted, so that the cutout 10 need not be formed by cutting.

Figure 10:
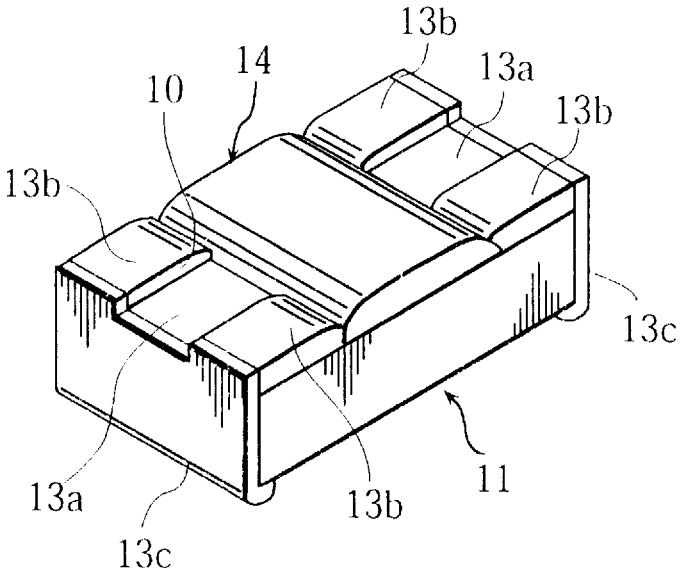

Then, as shown in FIG. 10, each of the side electrode layers 13*c* is formed on a respective end face of the chip substrate 11 by applying a silver-palladium paste which is later dried and baked for fixation.

Finally, each of the plated metal electrode layers 13*d* is formed on the auxiliary top electrode layer 13*b*, the side electrode layer 13*c* and the exposed portion of the main top electrode layer 13*a* by first plating with nickel followed by plating with solder or tin (see FIGS. 1–5).

According to the manufacturing process described above, the trimming of the resistor film 12 accompanied by resistance measurement is performed (FIG. 7) before each auxiliary top electrode layer 13*b* is formed (FIG. 9). However, since the auxiliary top electrode layer 13*b* is subsequently formed to have the cutout 9 where the plated metal electrode layer 13*d* having a negligible resistivity is brought into direct contact with the main top electrode 13*a*, the adjusted resistance of the resistor film 12 may be kept within a predetermined tolerable range.

Figure 11:
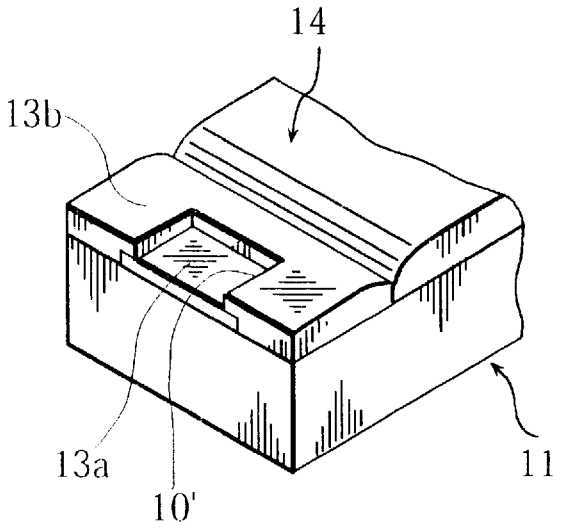
FIG. 11 is a perspective view showing a principal portion of a chip resistor device according to a second embodiment of the present invention.
Figure 12:
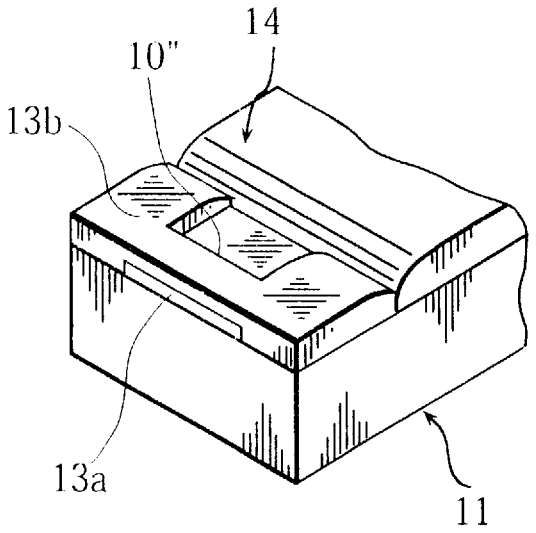
FIG. 12 is a perspective view showing a principal portion of a chip resistor device according to a third embodiment of the present invention.

In the first embodiment shown in FIGS. 1–5, the cutout 10 completely divides each auxiliary top electrode layer 13*b* into two separate portions. However, the auxiliary top electrode layer 13*b* may be formed with a non-dividing cutout 10' which is open upwardly and toward a respective end face of the substrate 11, as shown in FIG. 11 (second embodiment). Alternatively, the auxiliary top electrode layer 13*b* may be formed with a non-dividing cutout 10" which is open upwardly and toward the resistor film, as shown in FIG. 12 (third embodiment).

Figure 13:
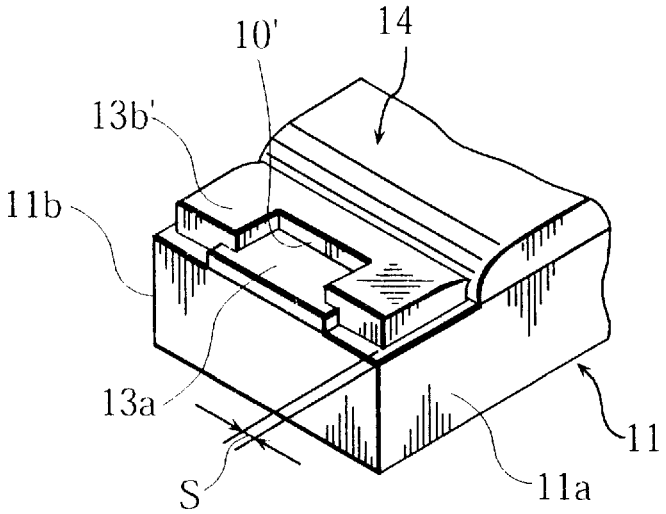
FIG. 13 is an enlarged sectional view taken along lines III—III in FIG. 1.

FIG. 13 shows a chip resistor device according to a fourth embodiment of the present invention wherein each end of the chip substrate 11 is formed with an auxiliary top electrode layer 13*b'* which is slightly spaced from both longitudinal edges 11*a*, 11*b* of the substrate 11. Like the second embodiment shown in FIG. 11, the auxiliary top electrode layer 13*b'* is formed with a non-dividing cutout 10' which is open upwardly and toward a respective end face of the substrate 11.

According to the fourth embodiment, since the auxiliary top electrode 13*b'* is slightly spaced from both longitudinal edges 11*a*, 11*b* of the substrate 11, the chip resistor device can be smoothly pushed into a feed tube used for automatic feeding thereof even if the plated metal electrode layer 13*d* (see FIG. 1) subsequently formed by plating is burred.

Figure 14:
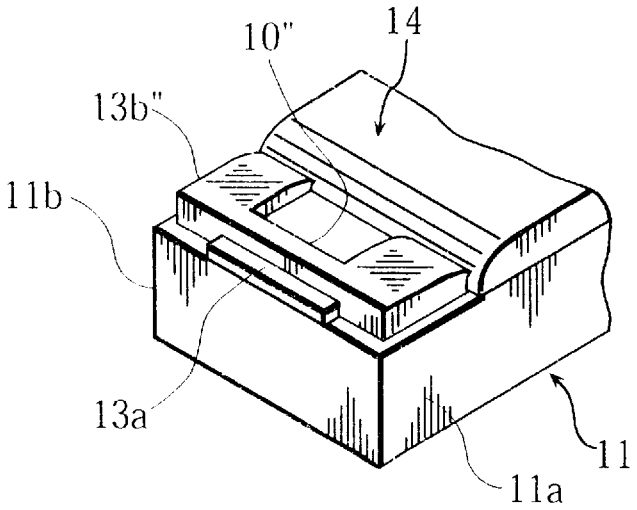
FIG. 14 is a perspective view showing a principal portion of a chip resistor device according to a fifth embodiment of the present invention.

FIG. 14 shows a chip resistor device according to a fifth embodiment of the present invention wherein each end of the chip substrate 11 is formed with an auxiliary top electrode layer 13*b"* which is slightly spaced from both longitudinal edges 11*a*, 11*b* of the substrate 11. Like the second embodiment shown in FIG. 12, the auxiliary top electrode layer 13*b"* is formed with a non-dividing cutout 10" which is open upwardly and toward the resistor film. Apparently, the chip resistor device of the fifth embodiment has the same advantage as that of the fourth embodiment.

The present invention being thus described, it is obvious that the same may be varied in many other ways. Such variations are not to be regarded as a departure from the spirit and scope of the invention, and all such variations as would be obvious to those skilled in the art are intended to be included within the scope of the following claims.

I claim:

1. A chip resistor device comprising;

an insulating chip substrate having a top surface and an opposite pair of end faces;

a resistor film formed on the top surface of the chip substrate;

a protective coating formed on the top surface of the chip substrate for covering the resistor film, and a pair of terminal electrodes provided at both ends of the chip substrate, each of the terminal electrodes including a main top electrode layer formed on the top surface of the chip substrate in electrical conduction with the resistor film, an auxiliary top electrode layer formed on the main top electrode layer, a side electrode layer formed on a corresponding end face of the chip substrate, and a plated metal electrode layer formed on the auxiliary top electrode layer and the side electrode layer;

wherein the auxiliary top electrode layer is formed with a cutout into which the plated metal electrode layer extends for coming into direct contact with the main top electrode layer.

2. The chip resistor device according to claim 1, wherein the cutout completely divides each auxiliary top electrode layer into two separate portions.

3. The chip resistor device according to claim 1, wherein each auxiliary top electrode layer is an integral one-piece, the cutout being open upwardly and toward the corresponding end face of the chip substrate.

4. The chip resistor device according to claim 1, wherein each auxiliary top electrode layer is an integral one-piece, the cutout being open upwardly and toward the resistor film.

5. The chip resistor device according to claim 1, wherein each auxiliary top electrode layer is slightly spaced to longitudinal edges of the chip substrate.

6. The chip resistor device according to claim 1, wherein the resistor film is provided with a trimmed portion for resistance adjustment.

7. The chip resistor device according to claim 1, wherein the protective coating includes a primary coating layer formed directly on the resistor film, and a second coating layer formed on the primary coating layer.

* * * * *